US007823332B2

(12) United States Patent
Siegel

(10) Patent No.: US 7,823,332 B2
(45) Date of Patent: Nov. 2, 2010

(54) REUSABLE STAIR COVER

(76) Inventor: Cynthia Siegel, 375 Ridgeview Dr., Pleasant Hill, CA (US) 94523

( * ) Notice: Subject to any disclaimer, the term of this patent is extended or adjusted under 35 U.S.C. 154(b) by 286 days.

(21) Appl. No.: 11/854,698

(22) Filed: Sep. 13, 2007

(65) Prior Publication Data

US 2008/0066389 A1 Mar. 20, 2008

Related U.S. Application Data

(60) Provisional application No. 60/844,693, filed on Sep. 15, 2006.

(51) Int. Cl.
*E04B 1/34* (2006.01)

(52) U.S. Cl. ..... 52/3; 52/177; 52/182; 428/77

(58) Field of Classification Search ..... 52/182, 52/186, 177, 179; 428/141, 77, 128
See application file for complete search history.

(56) References Cited

U.S. PATENT DOCUMENTS 1,674,713 A * 6/1928 Brooks ..... 52/179
2,026,317 A * 12/1935 Mckenzie ..... 428/95
6,640,501 B1 * 11/2003 Hussey ..... 52/3
7,073,297 B2 * 7/2006 Grinstead ..... 52/182
7,421,824 B1 * 9/2008 Green ..... 52/182

* cited by examiner

*Primary Examiner*—Richard E Chilcot, Jr.
*Assistant Examiner*—Chi Q Nguyen
(74) *Attorney, Agent, or Firm*—Steven R. Vosen

(57) ABSTRACT

A reusable stair cover is described having a length of washable material for covering a number of stair treads and intervening risers. At least one tread-covering portion of the cover includes a non-slip finish for contacting with the stair tread. Alternatively, each tread-covering portion further includes means for accepting a rigid insert. In another alternative embodiment, the length of the tread-covering portion is approximately a minimum tread length, and the portions between the tread-covering portions is long enough so that the stair cover can cover a range of staircase geometries.

14 Claims, 3 Drawing Sheets

100
101
103
105
401
403
400

100
101
103
102
405
401
403
400

REUSABLE STAIR COVER

CROSS-REFERENCE TO RELATED APPLICATIONS

This application claims the benefit of U.S. Provisional Application No. 60/844,693 filed Sep. 15, 2006, the entire contents of which are hereby incorporated by reference herein and made part of this specification.

BACKGROUND OF THE INVENTION

1. Field of the Invention

This invention relates to a protective cover for stairs, and more specifically to a cover that is reusable.

2. Discussion of the Background

Stairs are commonly protected during the painting or construction of adjacent areas by tarpaulins. Thus, for example, non-reusable plastic or unwieldy waterproofed fabrics are typically used during the construction of homes and offices to safeguard finished or carpeted stairs. When the tarpaulin becomes unusable due, for example, to tearing or because it no longer covers the desired stair area, it must be replaced or repositioned, costing both time and money.

When constructing near finished, non-carpeted stairs, non-reusable plastic materials are not recommended for finished stairs. In addition, even when the tarpaulin is reusable, it is generally of a size and shape that makes it difficult to clean. Equally significant, as will be recognized by workers in the construction industry, such as general contractors, plumbers, painters, decorators, and carpenters, the removal of conventional tarpaulins often results in the inadvertent spreading of the debris back onto the stair surfaces that it was designed to protect. These "stair protectors" are neither easy to use nor provide for economical reuse between jobs.

Thus there is a need in the art for a cover that conforms to stairs, is reusable, and permits the stairs to be used while covered. Such a cover should be foldable into a compact shape for storage, machine washable, and durable.

BRIEF SUMMARY OF THE INVENTION

The problems with prior art covers for a flight of stairs are solved by a cover that includes a material having a length and width necessary to conform to a flight of stairs. In certain embodiments, the length includes alternating first portions and second portions. The first portions have a length sufficient to cover the stair treads. The second portions have a length sufficient to protect the stair risers and any uncovered stair tread. At least one first portion includes a non-slip finish for contacting the stair tread. In an alternative embodiment, each first portion further includes means for accepting a removable rigid insert. In another alternative embodiment, the length of the cover is sufficient to conform to a straight flight of stairs, with the length of each first portion approximately equal to a minimum tread length, and the length of each second portion long enough so that the cover can conform to a range of stair geometries.

In certain embodiments, the cover includes a heavy loomed fabric and the non-slip finish is provided by a non-skid plastic portion attached to the heavy loomed material.

In certain other embodiments, the cover is sized to fit on a standard flight of stairs. In yet another embodiment, the cover includes extra material to accommodate a non-standard flight of stairs.

In certain embodiments, the cover is usable on both carpeted and non-carpeted stairs.

In certain embodiments, a cover for a flight of stairs is provided. The cover has a first side for placement on the stairs, and includes a sheet having shape to conform to the flight of stairs, where the stair covering is machine-washable, and one or more non-slip portions on the first side, where the position of the one or more non-slip portions corresponds to the treads of the flight of stairs.

In certain other embodiments, a cover for a flight of stairs is provided. The cover has a first side for placement on the stairs, and includes a sheet having shape to conform to the flight of stairs, where the stair covering is machine-washable; and a pocket in the sheet located at at least one position corresponding to the treads of the flight of stairs.

In certain embodiments, a cover for a flight of stairs is provided. The flight of stairs has a plurality of evenly spaced treads. The cover has a first side for placement on the stairs, and includes an elongated sheet having a plurality of tread portions. At least one of the plurality of tread portions includes a non-slip finish, and the elongated sheet is adapted to generally conform to the flight of stairs with adjacent elongated sheet tread portions covering adjacent treads of the flight of stairs.

In certain other embodiments, a cover for a flight of stairs is provided. The flight of stairs has a plurality of evenly spaced treads. The cover has a first side for placement on the stairs, and includes an elongated sheet having a plurality of tread portions. At least one of the plurality of tread portions includes a pocket adapted to accept a substantially flat insert. The elongated sheet is adapted to generally conform to the flight of stairs with adjacent elongated sheet tread portions covering adjacent treads of the flight of stairs.

These features together with the various ancillary provisions and features which will become apparent to those skilled in the art from the following detailed description, are attained by the cover of the present invention, preferred embodiments thereof being shown with reference to the accompanying drawings, by way of example only, wherein:

Reference symbols are used in the Figures to indicate certain components, aspects or features shown therein, with reference symbols common to more than one Figure indicating like components, aspects or features shown therein.

DETAILED DESCRIPTION OF THE INVENTION

Figure 1:
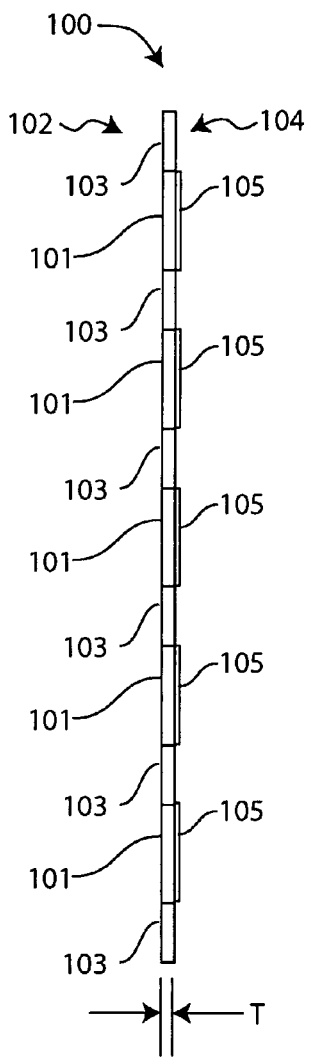
FIG. 1 is a side view of one embodiment of a cover.
Figure 2:
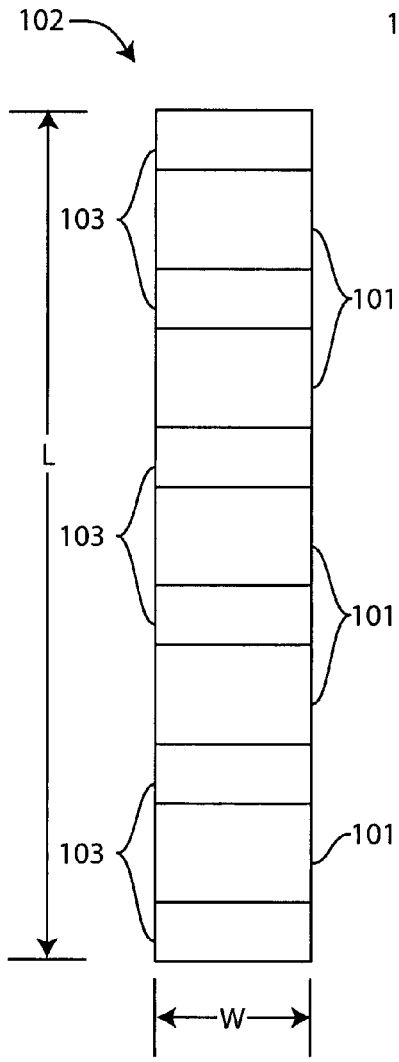
FIG. 2 is a top view of the cover of FIG. 1.
Figure 3:
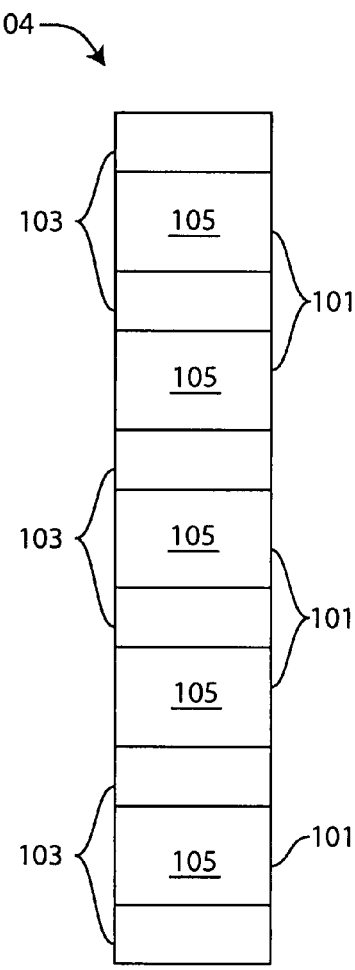
FIG. 3 is a bottom view of the cover of FIG. 1.

One embodiment of the present invention is shown in FIGS. 1, 2, and 3. Specifically, FIGS. 1, 2, and 3 are views of one embodiment of a cover 100 having a top side 102 and a bottom side 104, where FIG. 1 is a side view of the cover, FIG. 2 is a view of the top side, and FIG. 3 is a view of the bottom side.

The embodiment of cover 100 shown in FIG. 1 is an elongated sheet shaped to protect a straight flight of stairs, and has a width W, a length L, and a thickness T. Cover 100 may be formed from one or more pieces of material attached at their edges or in plies, or by combinations of different materials.

In one embodiment, cover 100 includes a plurality of alternating first portions 101 and second portions 103, each having width W. It is preferred that the material of cover 100 is sturdy and washable, and that thickness T is approximately 1 inch or less. It is also preferred that the width W may be, for example and without limitation, approximately 3 feet and that the length L is sized to such that there is one first portion 101 for every tread in the flight of stairs. FIGS. 1-3 show 5 stairs. For a standard flight of 13 stairs, the length L may be approximately 26 feet long. In an alternative embodiment, cover 100 may be shaped to cover non-straight stairs, or may be adapted for covering successive flights separated by landings by, for example, being the length of one half of a flight of stairs and have portions that overlap on a landing.

A substantial amount of the material of cover 100 includes a sturdy material that does not shrink upon repeated washing. In one embodiment, the sturdy material is a heavy duty fabric that is machine washable, and may be, for example and without limitation a blend of natural fibers (including, but not limited to cotton) and synthetic fibers (including but not limited to polyester or rayon). In one embodiment, the heavy duty fabric is a 61% cotton, 23% polyester, 16% rayon blend. Alternatively, cover 100 may include portions that may be removed prior to washing, such as strengthening inserts.

In general, first portions 101 are sized to cover the treads of a staircase. One or more first portions 101 include a non-slip finish 105 on bottom side 104. In one embodiment, non-slip finish 105 is provided by a material adhered to the sturdy material over portion 103. One suitable material having non-slip finish 105 is a blown polyvinyl chloride (PVC) sheet having a thickness of from 2 mil to 4 mil. One such sheet is manufactured under the name of MAGIC COVER™, and is manufactured by the Kittrich Corporation (La Mirada, Calif.).

In another embodiment, the non-slip finish is provided by impregnating a portion of 103 of the sturdy material with rubber or plastic. Preferably, the first portions 101 form part of cover 100 or are affixed to the cover, and can be subjected to repeated machine washing.

Figures 4, 5:
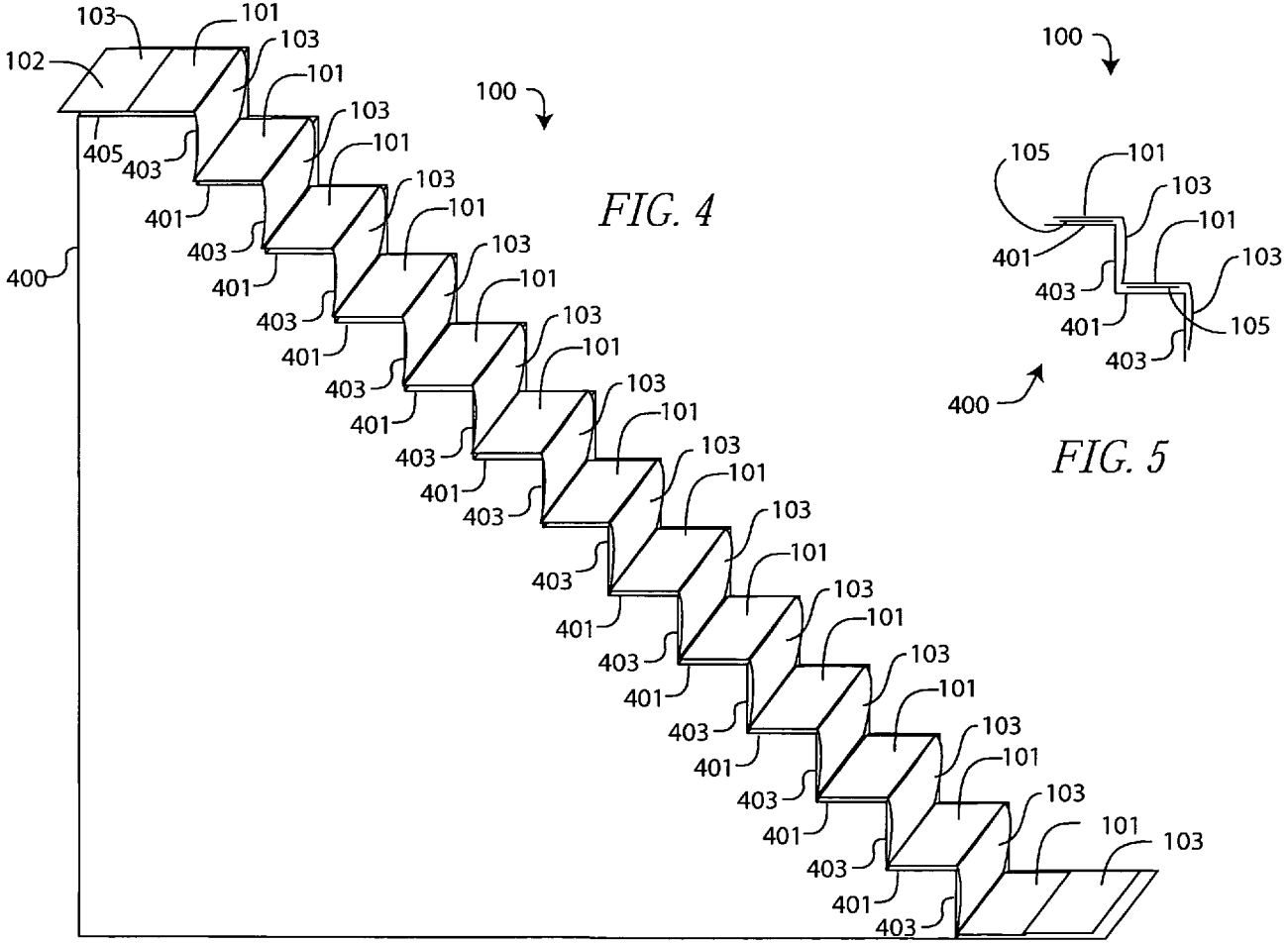
FIG. 4 is a perspective view illustrating a second embodiment cover on a flight of stairs.
FIG. 5 is a detailed side view of FIG. 4.

FIG. 4 is a perspective view illustrating a second embodiment cover 100 placed on a straight flight of stairs 400, where the stairs have a plurality of treads 401 and risers 403, and landings 405. FIG. 5 is a detailed side view of FIG. 4 showing two consecutive treads and risers. Cover 100 of FIGS. 4 and 5 are generally similar to those of FIGS. 1-3. Cover 100 is shown on flight of 13 stairs 400 with top side 102 facing upwards, and with the non-slip finish 105 of first portions 101 supported on treads 401, and second portions 103 covering the risers, as shown in FIG. 5.

Second portions 103 have a length that is sufficiently long so that cover 100 generally conforms to the shape of stairs 400. Thus, for example, if first portion 101 is not sufficiently long enough to cover tread 401, then a part of second portion 103 may also rest on tread 401. Second portion 103 may also include more material than would be required to cover a standard riser to account for a non-standard tread or riser, or to account for nosing.

FIGS. 6 through 10 illustrate a portion of a third embodiment cover 100. As described subsequently in greater detail, the third embodiment cover 100 of FIG. 6 through 10 includes two sheets of fabric sewn together to form the length L and width W of cover 100, sheets of PVC sewn to back side 104 of first portions 101 to provide non-slip finish 105, and removable inserts provided at first portions 101 to provide added structure to the cover.

Figure 6:
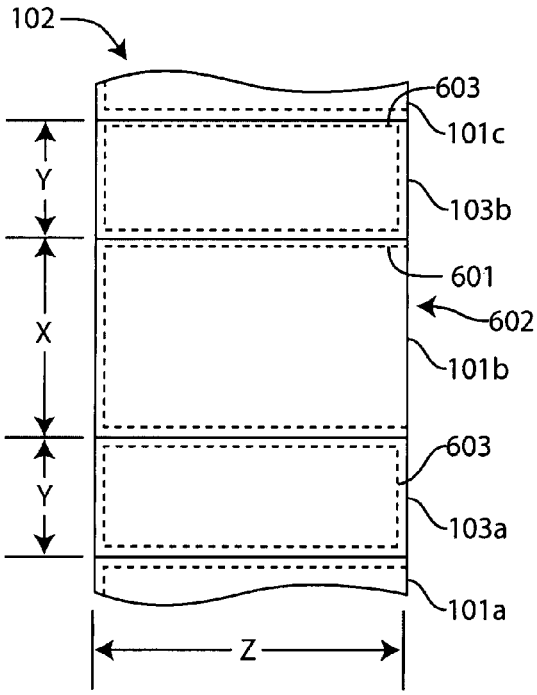
FIG. 6 is a top view of a portion of a third embodiment cover.
Figure 7:
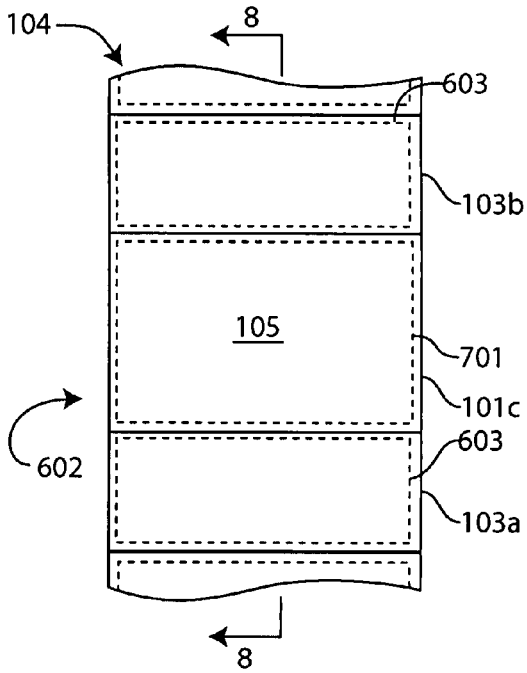
FIG. 7 is a bottom view of a portion of the cover of FIG. 6.
Figure 8:
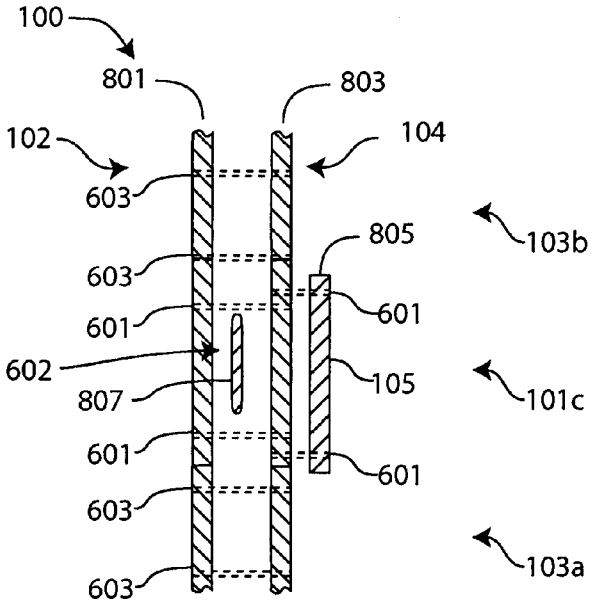
FIG. 8 is an exploded sectional view 8-8 of FIG. 7.
Figure 9:
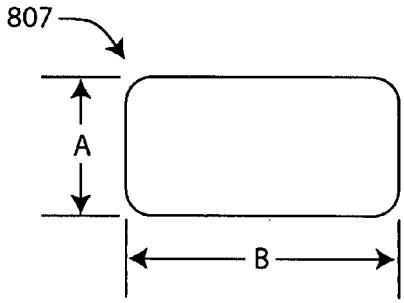
FIG. 9 is a top view of one embodiment of a tread insert.
Figure 10:
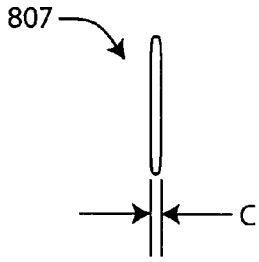
FIG. 10 is a side view of the tread insert of FIG. 9.

More specifically, the Figures show, in FIG. 6, a view of top side 102 of three first portions 101 (a first portion 101*a*, a second first portion 101*b*, and a third first portion 101*c*) and two intervening second portions 103 (a first second portion 103*a* and a second second portion 103*b*), in FIG. 7 a view of bottom side 104, in FIG. 9 a top view of one embodiment of a tread insert 807, and in FIG. 10 a side view of the tread insert. FIG. 8 is an exploded sectional view 8-8 of FIG. 7, showing the individual materials and the stitching separated from each other as an indication of the assembly of cover 100.

It is to be understood that the third embodiment may include a number of alternating first and second portions, as in the first or second embodiment covers 100 and may, for example and without limitation, include portions to cover a standard flight of stair, such as 13 first portions. The embodiment of the cover of FIG. 6 through 10 is generally similar to the embodiments of FIGS. 1 through 5, except where explicitly noted.

As shown in FIGS. 6 through 8, the third embodiment cover 100 includes two pieces of material 801 and 803 that joined together, pieces of material 805 joined to material 803, and removable inserts 807. Material 801 form top side 102 and materials 803 and 805 form bottom side 104, with material 805 and removable insert 807 located at first positions 101. In one embodiment, materials 801 and 803 are heavy duty fabrics, material 805 is a sheet of PVC, and insert 807 is a rigid sheet, which may be, for example and without limitation, a sheet of plastic, metal, wood, or a composite material.

In one embodiment, material 801 and 803 both extend the length L and width W of cover 100. In another embodiment, materials 801 and 803 are stitched together to reinforce second portions 103, as indicated by stitching 603 in FIGS. 6-8. Materials 801 and 803 are also stitched together on three sides, as indicated by stitching 601 in FIG.6 and 8 to form a pocket 602, for insert 807, at first portion 101. The border of material 805 is stitched to material 803 on first portion 101, as indicated by stitching 701 in FIGS. 7 and 8. The purpose of material 805 is to prevent slipping of cover 100 from the steps. Thus, for example, material 805 of one embodiment has a shape to cover some or all of a step. In another embodiment, material 805 is rectangular and has a size that is less than the size of the step to be covered. In yet another embodiment, material 805 has the shape of an outline of a step to be covered. If material 805 is flexible enough to permit contouring of cover 100 over a flight of stairs, some of material 805 may extend beyond the step-covering portion.

FIGS. 9 and 10 show detail of insert 807. In one embodiment, the third embodiment cover 100 is provided with an insert 807 for each first portion 101. Inserts 807 may be removed when cover 100 is to be cleaned, or when the inserts need to be replaced. In one embodiment, insert 807 is a plastic insert with a length A of 10.75 inches, a width B of 33 inches, and a thickness C of 0.25 inches.

Thus, while there has been described what is believed to be the preferred embodiments of the invention, those skilled in the art will recognize that other and further modifications may be made thereto without departing from the spirit of the invention, and it is intended to claim all such changes and modifications as fall within the scope of the invention. For example, certain embodiments may also be used on a floor without steps Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner, as would be apparent to one of ordinary skill in the art from this disclosure, in one or more embodiments.

Similarly, it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

I claim:

1. A cover for a flight of stairs, said cover having a first side for placement on the stairs, the cover comprising:

a sheet having shape to conform to the flight of stairs, wherein said cover includes a machine-washable material; and a pocket in said sheet located at a position corresponding to a tread of the flight of stairs, wherein said pocket forms an opening adapted to removably accept an inert.

2. The cover of claim 1, wherein said sheet includes two or more sheets joined together.

3. The cover of claim 1 further comprising one or more non-slip portions on the first side, wherein the position of said one or more non-slip portions corresponds to the treads of the flight of stairs, wherein said sheet includes a fabric, and wherein each of said one or more non-slip portions include a piece of a material joined to said sheet.

4. The cover of claim 3, wherein said machine-washable material is a plastic material.

5. The cover of claim 1, wherein said cover further includes at least one insert removably placeable within said pocket.

6. The cover of claim 1, wherein said sheet has a first edge extending the length of the first side and a second edge opposite said first edge and extending the length of the first side, and wherein said pocket is substantially open along only one of said first edge or said second edge.

7. The cover of claim 1, wherein said sheet is a flexible sheet.

8. A cover for a flight of stairs, wherein the flight of stairs has a plurality of evenly spaced treads, said cover having a first side for placement on the stairs, said cover comprising:

at least one insert; and an elongated sheet having a plurality of tread portions, wherein at least one of said plurality of tread portions includes a pocket adapted to removably accept a substantially flat insert, wherein said at least one insert is placed within said pocket, and wherein said elongated sheet is adapted to generally conform to the flight of stairs with adjacent elongated sheet tread portions covering adjacent treads of the flight of stairs.

9. The cover of claim 8, wherein said elongated sheet includes two or more sheets joined together.

10. The cover of claim 8, wherein said plurality of tread portions is thirteen tread portions.

11. The cover of claim 8, further comprising a non-slip finish on at least one of said plurality of tread portions, wherein said sheet includes a fabric, and wherein each of said non-slip finish includes a piece of a material joined to said sheet.

12. The cover of claim 11, wherein said material is a plastic material.

13. The cover of claim 8, wherein said sheet has a first edge extending the length of the first side and a second edge opposite said first edge and extending the length of the first side, and wherein said pocket is substantially open along only one of said first edge or said second edge.

14. The cover of claim 8, wherein said sheet is a flexible sheet.

* * * * *